US007196633B2

(12) United States Patent
Ardelan, Jr. et al.

(10) Patent No.: US 7,196,633 B2
(45) Date of Patent: Mar. 27, 2007

(54) INTEGRATED RADIO TOWER LIGHT CONTROLLER AND ALARM REPORTING DEVICE

(75) Inventors: John Patrick Ardelan, Jr., Batavia, IL (US); Darrell Gene Dearing, Greenwood, IN (US); George Lester Phelps, Novi, MI (US)

(73) Assignee: AT&T Knowledge Ventures, LP, Austin, TX (US)

( * ) Notice: Subject to any disclaimer, the term of this patent is extended or adjusted under 35 U.S.C. 154(b) by 886 days.

(21) Appl. No.: 10/029,927

(22) Filed: Dec. 31, 2001

(65) Prior Publication Data

US 2003/0122680 A1 Jul. 3, 2003

(51) Int. Cl.
*G08B 21/00* (2006.01)

(52) U.S. Cl. ..... 340/641; 340/983; 340/981; 315/132

(58) Field of Classification Search ..... 340/981, 340/642, 641, 983; 315/132, 130
See application file for complete search history.

(56) References Cited

U.S. PATENT DOCUMENTS 3,828,334 A 8/1974 Wallace ..... 340/251
4,518,963 A 5/1985 Rogers, Jr. ..... 340/981
4,594,632 A * 6/1986 Unnewehr ..... 361/33
5,397,963 A 3/1995 Manson ..... 315/129
5,446,450 A * 8/1995 Knutson ..... 340/635
5,671,999 A * 9/1997 Guthrie et al. ..... 362/184
5,801,634 A * 9/1998 Young et al. ..... 340/635
6,119,076 A 9/2000 Williams et al. ..... 702/188
6,445,592 B1 * 9/2002 Schirmer ..... 361/762

OTHER PUBLICATIONS

*Intelligent Tower-Lighting Alarm Monitor Installation Manual*, Transtronics, Inc., 1994.

* cited by examiner

*Primary Examiner*—Anh V. La
(74) *Attorney, Agent, or Firm*—Lacasse & Associates, LLC; Randy W. Lacasse; Ramraj Soundararajan

(57) ABSTRACT

An integrated radio tower light controller and alarm reporting device is described that is made up of solid-state current sensing modules that monitor the AC current distributed to the various lights/beacons and report various alarm modes. In addition, a solid-state flasher module is used to flash the radio tower beacons at the FAA/FCC specified rate along with reporting various alarm modes. Two mechanical relays are also included for reporting failures with the flasher module and AC power failure. Connecting terminals and testing switches are included to connect to various power leads, alarm leads, and to test the various functions of the device.

16 Claims, 4 Drawing Sheets

| Circuit Module | Component |
|---|---|
| Universal Lamp Alarm Relays For The "A" Beacon | SCR430T |
| Universal Lamp Alarm Relays For The "B" Beacon | SCR430T |
| Universal Lamp Alarm Relays For The "Side Light" Beacon | SCR430T |
| Flasher and Beacon Alarm Relay | FB120A |
| Beacon Flasher Auxiliary Unit | FS 155-30T |
| Flasher Fail Relay | Dayton Electric 5X824E(?) |
| AC Fail Relay | Dayton Electric 5X824E(?) |

Figure 2

INTEGRATED RADIO TOWER LIGHT CONTROLLER AND ALARM REPORTING DEVICE

BACKGROUND OF THE INVENTION

1. Field of Invention

The present invention relates generally to the field of tower lighting controllers. More specifically, the present invention is related to an integrated tower lighting controller with an alarm circuit.

2. Discussion of Prior Art

Buildings that are over a certain height are by law required to be equipped with a radio tower light. Additionally, in the United States of America, the Federal Communications Commission (FCC) and the Federal Aviation Administration (FAA) stipulate that the radio tower lights that are on such buildings are required to flash at a certain rate. Failure to flash at the set flash rates often results in huge fines. Typically, a controller circuit is used to control the rate of flashing. For example, old controller circuits use electromechanical components to comply with the flash rates stipulated by the FCC and FAA.

Prior art systems with such electromechanical radio tower light controllers fail to last due to the extreme conditions they are subjected to, and often have to be replaced with newer light controllers. However, there is no comprehensive "off the shelf" solution that allows one to replace such electromechanical tower light controllers with newer controllers that are 100% compatible with already existing equipment. Furthermore, the lifetime associated with current replacement light controller systems is limited, and thus they have to be replaced over periods of time.

A common reinforcement material used for mounting prior art replacement tower light controller devices is a phenol-based board. These phenol-based boards are weak, lightweight, and do not last very long, and thus have to be replaced periodically.

Thus, these replacement tower light controller devices have been "ad-hoc" at best and usually have been a conglomeration of devices that were not standardized across the industry and did not perform all of the required functions. It has been a "mixed bag" of whatever worked in a limited sense or a "quick fix" by the responsible party. In light of the above-mentioned FCC/FAA requirements, time limits, schedule of fines, and ultimately corporate image, these ad-hoc solutions were found to be lacking in many areas.

The following patents provide for a general description of alarm monitoring in pre-existing radio tower light controllers.

The U.S. Pat. No. 3,828,334 provides for a remote monitoring of tower lighting system, wherein the system continuously monitors the condition of a tower's obstruction and beacon lights and transmits status information to a remote location. This system incorporates logic circuitry to continuously measure the operations of each of these lights and upon failure, transmits an alarm signal over an existing channel to the remote control station.

The U.S. Pat. No. 4,518,963 provides for an automatic indicator for tower lights via a circuit that monitors the status of the tower lights and detects and indicates failure of various components of the lighting system. Primarily, this circuit's function is to detect and indicate failures of one or both of the top lights and failures of one or more of the side lights. This is done using a comparator that detects a voltage drop due to the failure of the monitored light.

The U.S. Pat. No. 5,397,963 provides a subsystem that remotely monitors a system of lights, such as the control towers of an airport, and accurately reports failure of a particular light in the system. This subsystem consists of an operation monitor processor, lamp controllers, a remote lamp transceiver module for each lamp, and an existing AC loop wiring. Upon failure detection of a particular light in the system, data is transmitted over power wiring to the remote monitoring location.

The U.S. Pat. No. 6,119,076 provides for a lamp monitoring and control unit and method for remotely monitoring and controlling the operation of a streetlight. During operation, the system continuously monitors multiple parameters of the lighting unit that include the on/off status and current of the unit.

The non-patent literature entitled "Intelligent Tower-Lighting Alarm Monitor Installation Manual" discloses a device that continuously monitors the operations of 'red lighted' towers including the detection of various alarm states. Major alarms of this system include failure of both beacon lamps, power failure for more than 20 hours, and lack of power being supplied to the lighting control panel. Minor alarms consist of failure of one or more side lamps, the flasher being "on" continuously, one or more beacon lamps being out, and possible bulb shortage.

Whatever the precise merits, features and advantages of the above cited references, none of them achieve or fulfills the purposes of the present invention.

SUMMARY OF THE INVENTION

The present invention provides for an integrated radio tower light controller and alarm reporting device. This device is made up of solid-state current sensing modules that monitor the AC current distributed to the various lights/beacons and report various alarm modes. In addition, a solid-state flasher module is included to flash the radio tower beacons at the FAA/FCC specified rate along with reporting various alarm modes. Two mechanical relays are also included for reporting failures with the flasher module and AC power failure. Connecting terminals and testing switches are included to connect to various power leads, alarm leads, and to test the various functions of the device.

In an extended embodiment, all components, wiring, terminals, switches, and diodes are mounted to a specially fabricated 0.125 inch metal backplate that has been designed and specially drilled and tapped. This metal backplate is then bolted in place within the existing tower light controller cabinets using standoff insulators.

BRIEF DESCRIPTION OF THE DRAWINGS

FIG. 2 illustrates a table showing examples of modules that can be used to implement the circuitry of the present invention.

DESCRIPTION OF THE PREFERRED EMBODIMENTS

Figure 1:
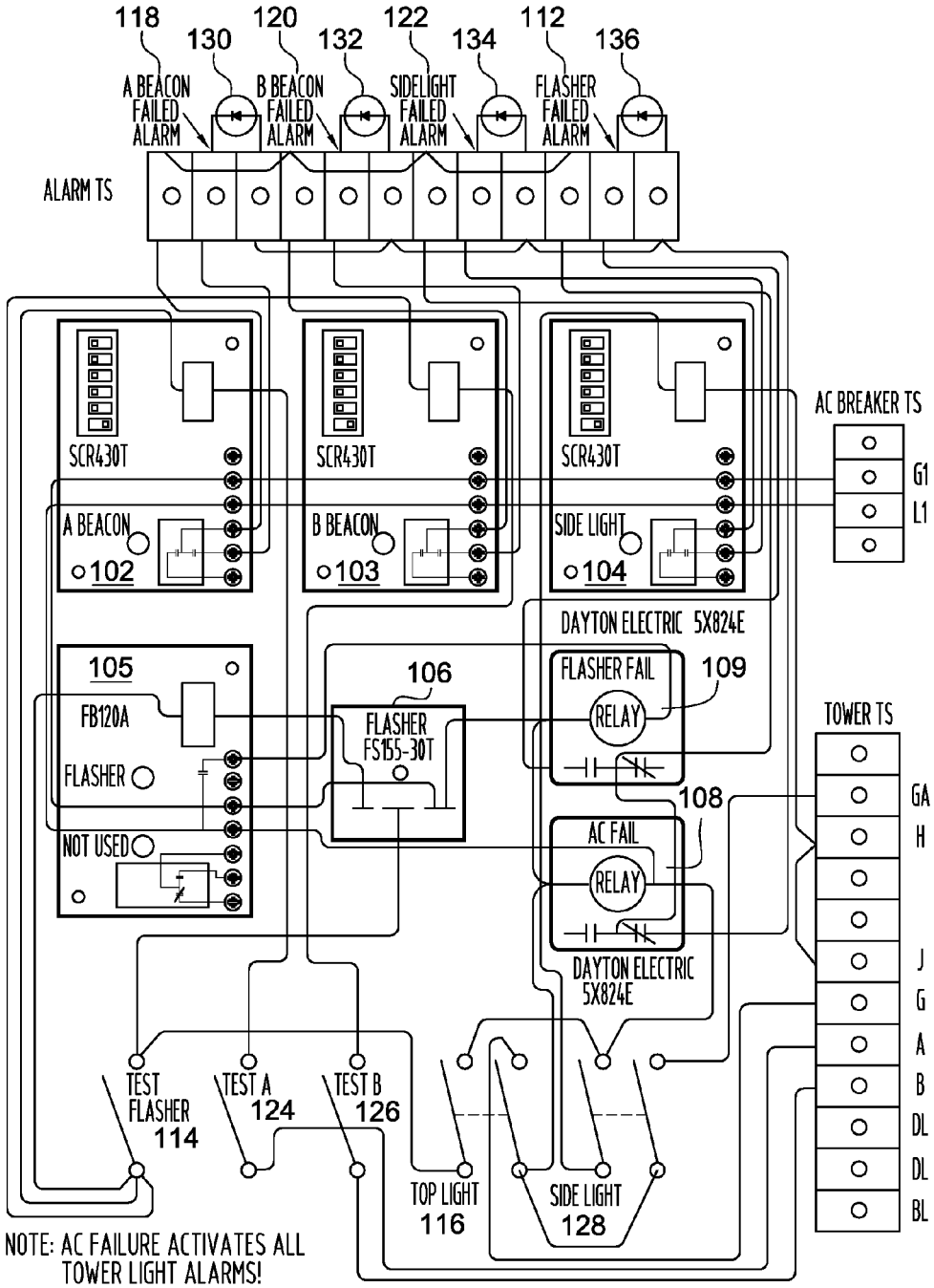
FIG. 1 illustrates a circuit diagram illustrative of the preferred embodiment of the present invention.

While this invention is illustrated and described in a preferred embodiment, the invention may be produced in many different configurations, forms and materials. There is depicted in the drawings, and will herein be described in detail, a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the present invention.

The present invention provides for an integrated radio tower light controller and alarm reporting device. In normal operation this device monitors the integrity of all wiring, electrical components, beacon and sidelight lamp filaments in a typical radio tower lighting scenario. In addition, this device also flashes the beacon lamp(s) at the required FCC/FAA rate. Furthermore, this device also monitors AC power and certain internal components of itself. Upon sensing a failure, certain alarms are reported locally and to a monitoring and alarm center.

In the preferred embodiment, the failed conditions and their associated alarms are as given below:

| | |
|---|---|
| Failed "A" Beacon | Send "A" beacon alarm through loop closure/open |
| Failed "B" Beacon | Send "B" Beacon alarm through loop closure/open |
| Failed Beacon Flasher | Send Flasher alarm through loop closure/open |
| Failed Side Light(s) | Send Sidelight alarm through loop closure/open |
| Failed AC Power | Send AC fail alarm through loop closure/open |

As noted earlier, these failures/alarms are critical since there is a finite time allowed by the FCC/FAA for failed lamps/beacons to be repaired/replaced or the company could face fines. This would pose a threat primarily to low flying aircraft in the region of the tower, as lighted towers frequently are within close proximity to airports.

The device of the present invention provides for many advantages over the above-described prior art, some of which include:

1) the device is manufactured via easily obtained off-the-shelf components;

2) the device reduces operational errors;

3) the device has long-life and outlives the prior art systems described above;

4) the device is easily installed in existing lighting systems;

5) the device seamlessly works with existing alarm systems;

6) the device covers all required monitoring/alarm functions; and 7) the device can be easily standardized throughout a region.

As mentioned above, the device of the present invention utilizes off-the-shelf components and its uniqueness is centered upon the way it is designed. It performs all required functions in one neat, integrated package.

FIG. 1 illustrates a circuit diagram 100 illustrative of the preferred embodiment of the present invention. The circuit 100 primarily consists of a universal lamp alarm relay for the "A" beacon 102, universal lamp alarm relay for the "B" beacon 103, a universal lamp alarm relay for the "side light" 104, a flasher and beacon alarm relay 105, a beacon flasher auxiliary unit 106, and a pair of mechanical relays 108 and 109.

FIG. 2 illustrates a table showing examples of modules that can be used to implement the above-mentioned circuitry of the present invention. It should, however, be noted that although the preferred embodiment uses various off-the-shelf components described in the above table, they are for illustrative purposes only, and thus, one skilled in the art can envision using other equivalent components without departing from the scope of the present invention. A brief description of each of the modules is given below.

As mentioned earlier, this is implemented using a universal lamp alarm relay SCR430T module. This module helps sense failures in steady beacon lamps. It primarily comprises a selector switch, a toroid, three isolated alarm outputs, and an LED.

Figure 3:
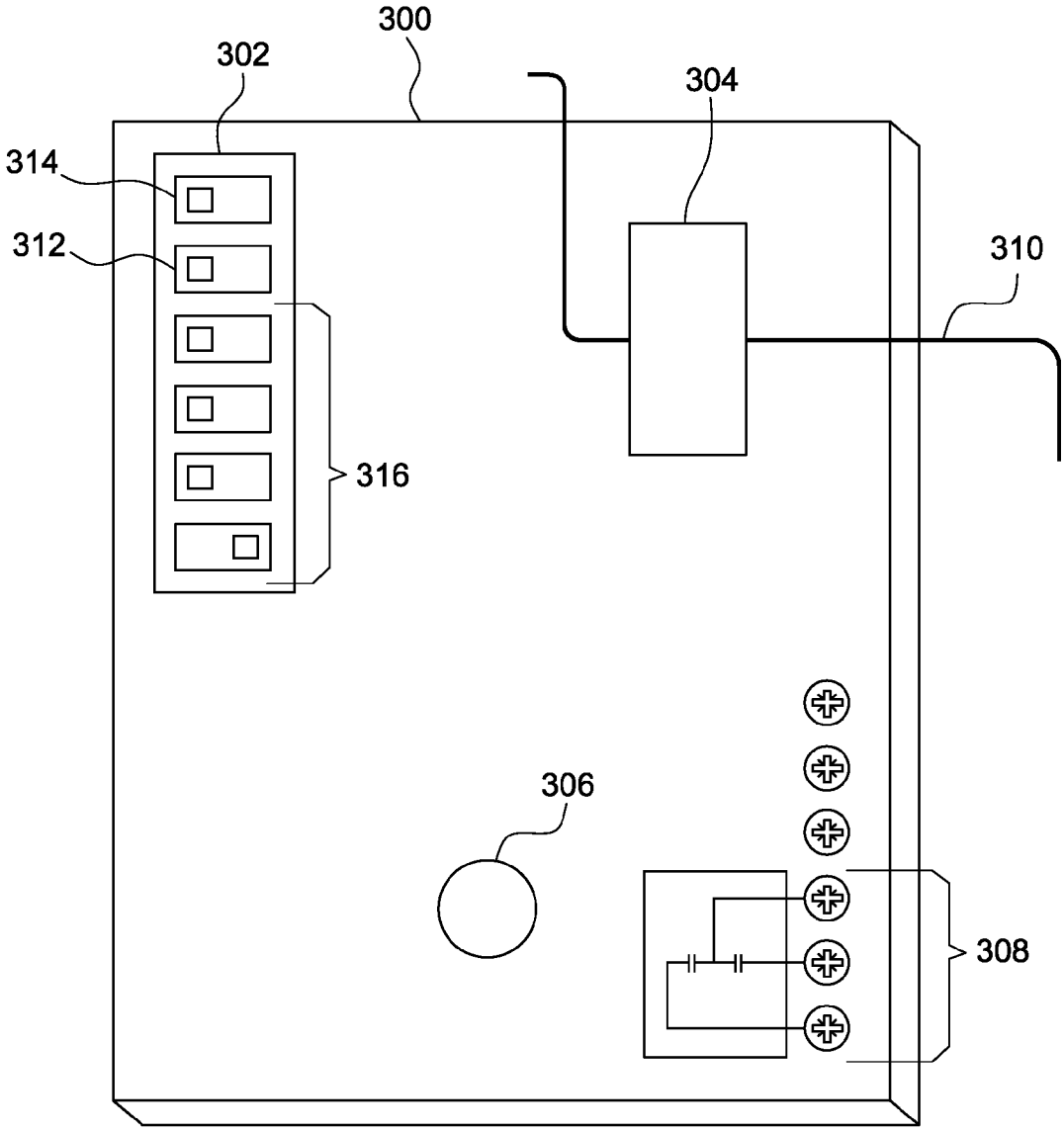
FIG. 3 illustrates a SCR430T module with a selector switch, a toroid, an LED, and three isolated alarm outputs.
Figure 4A:
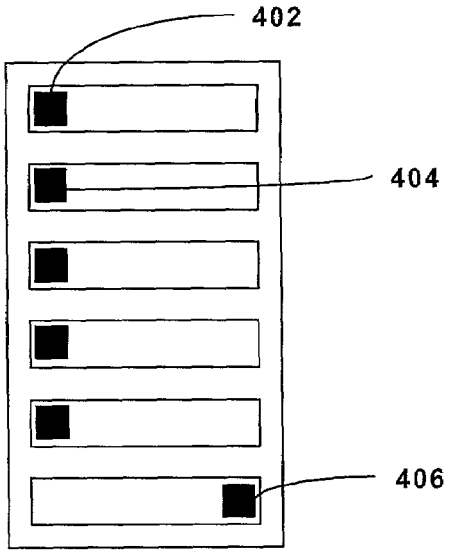
FIGS. 4*a–d* collectively illustrate the various modes of the selector switch that is used to select the number of lamps that are routed through the toroid.
Figure 4B:
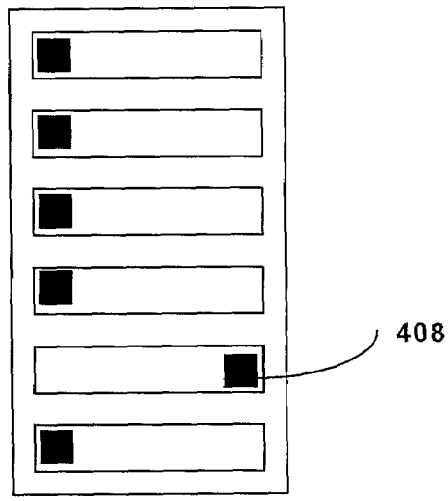
Figure 4C:
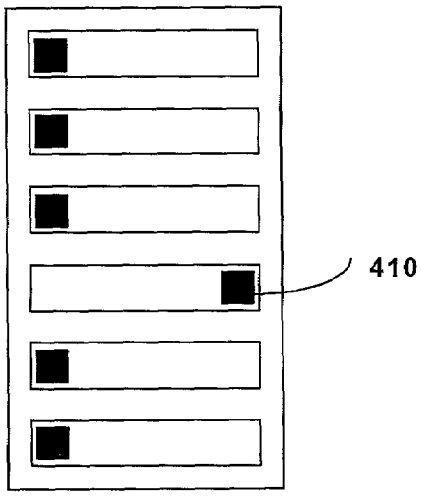
Figure 4D:
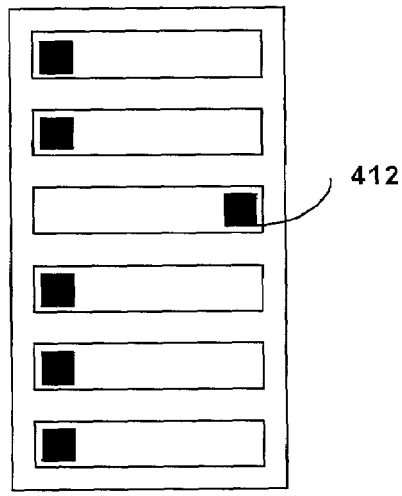

FIG. 3 illustrates a SCR430T module 300 with selector switch 302, toroid 304, LED 306, isolated alarm outputs 308. Selector switch 302 is used to select the number of lamps that are routed through the toroid 304. This is illustrated in FIGS. 4*a–c,* wherein FIG. 4*a* illustrates a scenario wherein one lamp is routed through the toroid, as indicated by switch 406 that is toggled on. FIGS. 4*b–c* illustrate a similar scenario wherein two, three, or four lamps are routed though the toroid, as indicated by switches 408, 410, and 412.

Returning to the discussion in FIG. 3, wire 310 bound to the lamp to be monitored is passed through toroid 304. The selector switch 302 indicates three parameters: the number of lamps that are being monitored (based upon switches 316), the voltage of the lamps being monitored (based upon how switch 312 is toggled; 120V for "0" and 130V for "1"), and the wattage of lamps being monitored (based upon how switch 314 is toggled; 620 W for "0" and 116 W for "1").

Returning to the discussion of FIG. 1, FS155-30T 106 is a solid-state flasher module for powering and flashing the top beacon(s) of a typical radio tower at a continuous rate set by the FCC/FAA. AC power is brought in on pins 2 and 3. The flashed AC is then routed through FB120A 105, which is a solid-state current sensing device. Upon sensing a loss of current or too slow/fast flashing rate from the FS155-30T 106, FB120A 105 energizes the coil of the "Flasher Fail" relay 109, which then places either a short or open (as required) on the alarm pair to the alarm unit, which then reports a "FLASHER FAIL" alarm 112.

The flashed AC is then routed to the "test flasher" switch 114 used for forcing a failed condition (shorted flasher) from the flasher unit, which will then also report a "Flasher Fail". The "test flasher" switch 114 causes the FS155-30T 106 to be bypassed, placing continuous (not flashed) AC on the beacon(s). The "Top Lights" switch 116 serves to disconnect AC from the FB155-30T flasher unit 106 and simulate an "Open Flasher" failure condition. Flashed AC is then routed to the top beacon(s) on the radio tower.

SCR430T (110, 103, and 104) are solid-state current sensing devices which monitor the "A" beacon, "B" beacon, and sidelight AC circuits. Upon sensing loss of current, these units (in turn) place either a short or open (as required) on the "A Beacon Failed" 118, "B Beacon Failed" 120 or "Sidelight(s) Failed" 122 alarm pairs respectively.

Test switches "Test A" 124, "Test B" 126, "Top Lights" 116, and "Side Lights" 128 all remove their respective loads from the device; thereby simulating lamp filament failures causing their respective alarms to be reported through their respective SCR430T current sensing device (110, 103, or 104).

Four 600V PIV diodes 130, 132, 134, 136 are placed across each alarm pair for isolation in conjunction with the AC fail circuit.

The "AC Fail" relay 108 is normally energized. Upon AC failure, this relay 108 will drop and place a short or open (as required) on all alarm pairs to the alarm unit, which then report "all alarms" which is interpreted as an AC Fail alarm.

In an extended embodiment, all components, wiring, terminals, switches, and diodes are mounted to a specially fabricated 0.125 inch metal backplate that has been designed and specially drilled and tapped. This metal backplate is then bolted in place within the existing tower light controller cabinets using standoff insulators. These backplates provide last longer under extreme conditions than the phenol-based boards described in the prior art.

Thus, the device of the present invention provides for an integrated tower lighting controller with alarm circuit that overcomes many pitfalls posed by the prior art.

CONCLUSION

A system and method has been shown in the above embodiments for the effective implementation of an integrated radio tower light controller and alarm reporting device. While various preferred embodiments have been shown and described, it will be understood that there is no intent to limit the invention by such disclosure, but rather, it is intended to cover all modifications and alternate constructions falling within the spirit and scope of the invention, as defined in the appended claims. For example, the present invention should not be limited by specific universal lamp alarm relay, specific flasher and beacon alarm relay, specific beacon auxiliary unit, specific relays, or specific hardware.

The invention claimed is:

1. An integrated radio tower light controller and alarm reporting device, said device comprising:

a. a current sensing module monitoring AC current distributed to one or more beacons and one or more lights, said module reporting one or more alarm modes associated with said beacons and lights via one or more alarm units;

b. a flasher module flashing said one or more beacons at a pre-determined flash rate and reporting one or more of said alarm modes via said one or more alarm units if any of said beacons fail to flash at said pre-determined flash rate;

c. a first mechanical relay for reporting failure in said flasher module via said one or more alarm units; and d. a second mechanical relay for reporting failure in said current sensing module via said one or more alarm units.

2. An integrated radio tower light controller and alarm reporting device, as per claim 1, wherein said device further comprises diodes placed across said alarm units for isolation in conjunction with a failure in AC power.

3. An integrated radio tower light controller and alarm reporting device, as per claim 2, wherein said diodes are peak inverse voltage (PIV) diodes.

4. An integrated radio tower light controller and alarm reporting device, as per claim 1, wherein said current sensing module and said flasher module are solid-state modules.

5. An integrated radio tower light controller and alarm reporting device, as per claim 4, wherein said device is compatible with existing tower light controllers and made functional via replacing electromechanical current sensing module or electromechanical flasher module in said existing tower light controllers with said solid-state current sensing module or said solid-state flasher module.

6. An integrated radio tower light controller and alarm reporting device, as per claim 1, wherein components of said integrated radio tower light controller and alarm reporting device are mounted on a metal backplate that is secured in place using standoff insulators.

7. An integrated radio tower light controller and alarm reporting device, said device comprising:

a. one or more alarm units;

b. a solid-state flasher module for powering and flashing one or more beacons of a radio tower at a predetermined flash rate;

c. a solid-state current sensing device tat is operatively linked to said solid-state flasher module for sensing either a failure in flashing at said predetermined flash rate or a failure in AC current, and upon sensing said failure activating said one or more alarm units; and d. at least three solid-state current sensing devices for monitoring AC current in "A" beacon, "B" beacon, and sidelights, and upon sensing failure in said monitored AC current, activating said one or more alarm units.

8. An integrated radio tower light controller and alarm reporting device, as per claim 7, wherein said one or more alarm units monitor one or more of the following components: "A" Beacon, "B" Beacon, solid-state flasher, side lights, or AC power.

9. An integrated radio tower light controller and alarm reporting device, as per claim 7, wherein said device is compatible with existing tower light controllers and made functional via replacing electromechanical current sensing module or electromechanical flasher module in said existing tower light controllers with said solid-state current sensing module or said solid-state flasher module.

10. An integrated radio tower light controller and alarm reporting device, as per claim 7, wherein components of said device are mounted on a metal backplate that is secured in place using standoff insulators.

11. An integrated radio tower light controller and alarm reporting device, as per claim 7, wherein said device further comprises diodes placed across said alarm units for isolation in conjunction with a failure in AC power.

12. An integrated radio tower light controller and alarm reporting device, as per claim 11, wherein said diodes are peak inverse voltage (PIV) diodes.

13. A method for replacing a pre-existing radio tower light controller with an integrated tower light controller and alarm reporting device, said pre-existing radio tower light controller comprising electromechanical flasher modules and electromechanical current sensing modules, said method comprising the steps of:

a. replacing said electromechanical flasher module with a solid-state flasher module for powering and flashing one or more beacons of a radio tower at a predetermined flash rate;

b. replacing said electromechanical current sensing modules with a solid-state current sensing device that is operatively linked to said solid-state flasher module for sensing either a failure in flashing at said predetermined flash rate or a failure in AC current, and upon sensing said failure activating one or more alarm units; and c. installing at least three solid-state current sensing devices for monitoring AC current in "A" beacon, "B" beacon, and sidelights, and upon sensing failure in said monitored AC current, activating said one or more alarm units.

14. A method for replacing a pre-existing radio tower light controller with an integrated tower light controller and alarm reporting device, said pre-existing radio tower light controller comprising electromechanical flasher modules and electromechanical current sensing modules, as per claim 13, wherein said method further comprises the step of placing one or more diodes across each of said alarm units for isolation in conjunction with a failure in AC power.

15. A method for replacing a pre-existing radio tower light controller with an integrated tower light controller and alarm reporting device, said pre-existing radio tower light controller comprising electromechanical flasher modules and electromechanical current sensing modules, as per claim 14, wherein said diodes are peak inverse voltage (PIV) diodes.

16. A method for replacing a pre-existing radio tower light controller with an integrated tower light controller and alarm reporting device, said pre-existing radio tower light controller comprising electromechanical flasher modules and electromechanical current sensing modules, as per claim 13, wherein said method further comprises the step of mounting components of said controller on a metal backplate that is secured in place using standoff insulators.

* * * * *